United States Patent [19]

Francis

[11] 4,407,104

[45] Oct. 4, 1983

[54] BRICK PANEL INSULATION WITH LOAD BEARING CLIP

[76] Inventor: Gerald T. Francis, 25257 W. Eight Mile Rd., Detroit, Mich. 48240

[21] Appl. No.: 192,943

[22] Filed: Oct. 2, 1980

[51] Int. Cl.[3] ..... E04B 1/38; E04B 2/00

[52] U.S. Cl. ..... 52/309.4; 52/314; 52/509; 52/593; 52/442

[58] Field of Search ..... 52/309.12, 314, 509, 52/315, 389, 391, 442, 434, 487, 774, 384, 385, 389, 390, 404, 410, 378, 379

[56] References Cited

U.S. PATENT DOCUMENTS

| | | | |
|---|---|---|---|
| 555,358 | 2/1896 | Balsley | 52/509 |
| 647,705 | 4/1900 | Rieseck | 52/442 |
| 923,507 | 6/1909 | Gibson | 52/434 |
| 2,317,428 | 4/1943 | Anderson | 52/509 |
| 2,732,705 | 1/1956 | Ray | 52/442 |
| 2,924,963 | 2/1960 | Taylor et al. | 52/442 |
| 2,938,376 | 5/1960 | Workman et al. | 52/314 |
| 4,299,069 | 11/1981 | Neumann | 52/314 |

*Primary Examiner*—John E. Murtagh
*Assistant Examiner*—Michael Safavi
*Attorney, Agent, or Firm*—Cullen, Sloman, Cantor, Grauer, Scott & Rutherford

[57] ABSTRACT

A brick panel wall construction is disclosed including a backing board for a brick panel which is formed of extruded plastic foam for moisture resistance and insulation. The wall construction includes a plurality of brick panels having plastic foam backing boards and a plurality of load bearing clip members that support the bricks which are secured to the backing boards. The load bearing clip members are sandwiched within the tongue and groove joints between adjacent upper and lower brick panels. Each load bearing member includes a protruding terminal lip that extends into the joint area between the bricks of adjacent panels. Mortar is packed or tuck pointed into the joint area to cover the protruding lips of the load bearing clips, and the clips become the support for the bricks that are secured to the plastic foam backing boards. Thus, the invention provides an improved insulating and moisture resistant backing board, and a direct mechanical connection of the bricks to the wall supporting structure such that the support for the bricks is not dependent upon the non-structural backing board.

2 Claims, 5 Drawing Figures

BRICK PANEL INSULATION WITH LOAD BEARING CLIP

BACKGROUND OF THE INVENTION

The present invention relates to improvements in brick panel wall constructions, and more particularly, to a brick panel construction including a plastic foam backing board and load-bearing clip members that support the bricks which are attached to the backing board.

It is conventional to provide brick panel walls which generally consist of one-half inch thick kiln-fired bricks secured in conventional patterns to a backing board by a means of an adhesive. The backing board may typically be formed of an asphalt-impregnated wood fiber material sixteen and one-half inches high by forty-eight inches long, so as to receive six rows of two and one-quarter inch high by seven and five-eighths inch long bricks. The brick panels are applied to the supporting structure by hand driven or power driven nails through the open spaces between the bricks. Mortar is then applied to these three-eighth inch or half-inch wide spaces so as to conceal the joints between adjacent panels, to conceal the nails, and also to render the completed installation indistinguishable from conventional brick constructions. These brick panels are conventionally used in either original construction or in remodeling applications.

Examples of brick panels are found in my prior U.S. Pat. No. 3,908,326 and in the prior art referred to therein. While the brick panels described in my earlier patent have been satisfactory, there are several characteristics of the product which could be further improved.

One such area is in the backing board itself, wherein improved moisture resistance, to avoid rotting or delamination, would increase the durability of the product and would permit such panels to be installed all the way down to ground level or below. The vulnerability to moisture of presently used backing boards requires that such panels be terminated six to eight inches above the ground, requiring more costly construction alternatives from that level downward below ground level.

The current concern with improved insulation to conserve energy makes it desirable to provide a backing board having increased thermal insulation value.

Another area for improvement is in the assembly of the bricks to the backing board such that the entire load from the bricks is not borne by the backing board. The bricks are typically attached to the backing board by adhesive, with no direct mechanical connection to the wall supporting structure. The adhesive is subject to oxidation and deterioration which may permit one or more bricks to break away from the backing board. Further, the loading of the bricks on the backing board causes the panel to drift in a vertical plane which is also undesirable. Thus, there has been a need for a direct mechanical connection between the bricks and wall supporting structure such that the support for the bricks is not dependent upon the bond between the bricks and backing board.

Accordingly, it is the principal object of the present invention to provide a brick panel construction having improved properties as described above.

SUMMARY OF THE INVENTION

The brick panel wall construction of the present invention includes a plurality of brick panels having polystyrene foam backing boards and a plurality of load-bearing clip members that support the bricks which are secured to the backing boards. Each backing board includes a plurality of bricks secured thereto in conventional patterns by adhesive. Mortar is applied to the spaces between the bricks to conceal the joints between adjacent bricks.

The backing boards are preferably formed of extruded polystyrene foam with tongue and groove joints in the long edges, to improve water run-off, insulation value and structural integrity. In attaching the brick panels to an existing stud wall, for example, each backing board is attached to the wall studs with its tongue at one edge being accommodated in a groove in the adjacent edge of the next-applied backing board. Prior to installing the first or lowermost panel on the wall studs, a full length base channel, ten to twelve feet long, is attached to the studs for sealing the bottom of the wall against rodents and the like. When the first or lowermost brick panel has been placed in position on the stud wall with its tongue exposed, a plurality of load bearing clip members, made in accordance with the present invention, are then applied over the tongue and secured to the wall studs. Each load bearing clip includes an outwardly projecting leg having a configuration that conforms to the tongue and groove connection between the backing boards of adjacent brick panels. The grooved edge of a second or upper brick panel is then pressed into position such that the load bearing clips are sandwiched within the tongue and groove joint between the upper and lower panels.

An important feature of the present invention resides in the individual load-bearing clips, each including a protruding lip on the outwardly projecting leg that extends into the joint area between the bricks of adjacent panels. When mortar is packed or tuck pointed into the joint area to cover the protruding lips of the load bearing clips, the clips become the support for the bricks that are secured to the polystyrene foam backing boards. In fact, the backing boards may be stripped away and the brick wall will remain intact, being supported solely by the load bearing clips, although this has only been done for testing purposes. Thus, the present construction provides an improved insulating and moisture resistant backing board, and a direct mechanical connection of the bricks to the wall studs such that the support for the bricks is not dependent upon the relatively non-structural backing board.

Other advantages and meritorious features of the brick panel wall construction of the present invention will be more fully understood from the following description of the preferred embodiment, the appended claims, and the drawings, a brief description of which follows.

DETAILED DESCRIPTION OF THE INVENTION

Figure 1:
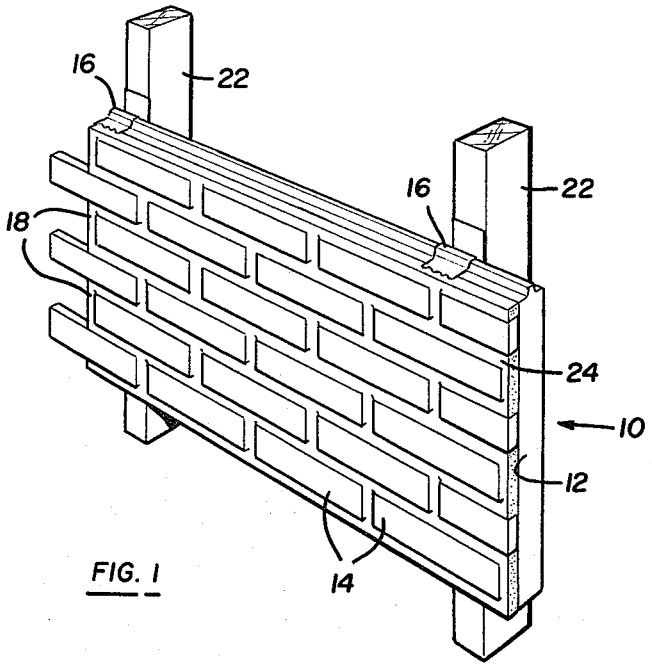
FIG. 1 is a perspective view of a brick panel attached to a stud wall including the load bearing clips of the present invention.

Referring to FIG. 1, a brick panel 10 comprises a backing board 12 to which a plurality of bricks 14 have been adhesively secured in a conventional pattern. Bricks 14 are preferably one-half inch thick by two and one-quarter inches wide by seven and five-eighths inches long kiln-fired bricks.

The present invention relates to improvements in brick panel wall constructions wherein the brick panel 10 includes a polystyrene foam backing board 12 and load bearing clip members 16 that support the bricks 14 which are attached to the backing board 12, as will be described.

Backing board 12 is preferably formed of extruded polystyrene foam one inch thick by sixteen and one-half inches wide by forty-eight inches long. Styrofoam SM brand insulation board manufactured by The Dow Chemical Company has been found to produce good results in the present brick panel wall construction, since it possesses the desired moisture resistance, insulation and strength properties. The backing boards 12 are extruded with tongue and groove joints in the long edges (FIGS. 4 and 5) to further improve structural integrity, insulation value, and water run-off.

Figure 2:
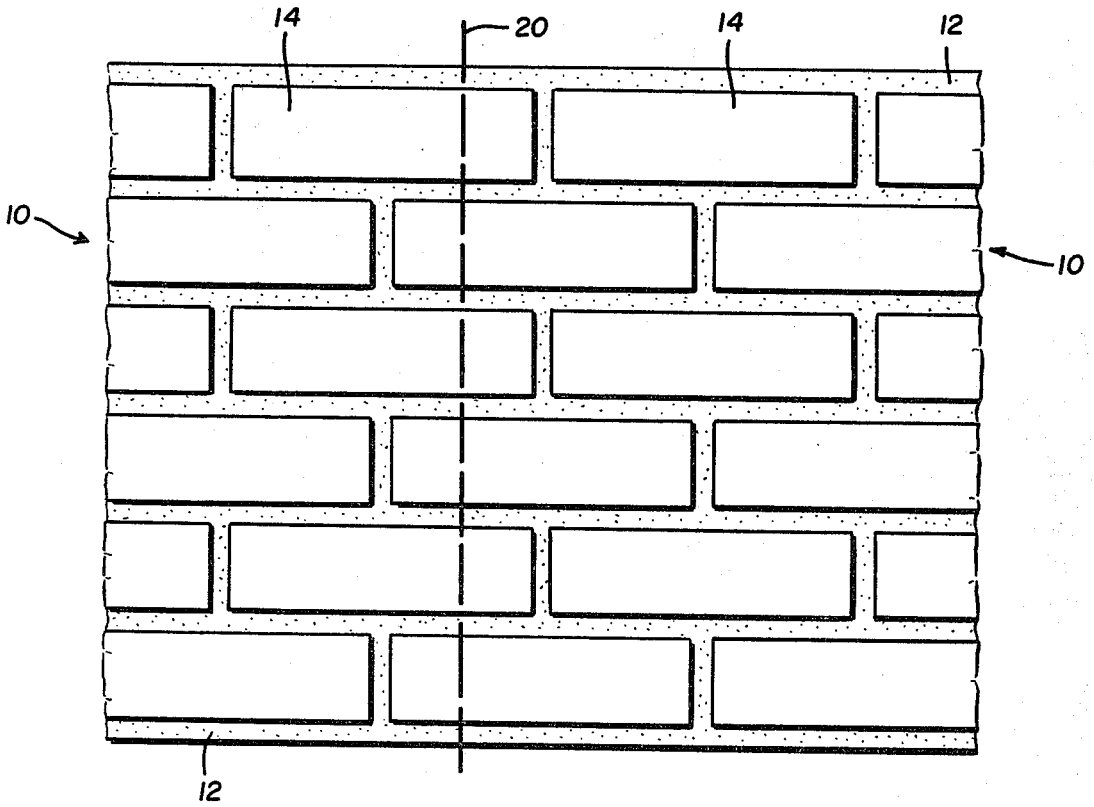
FIG. 2 is a fragmentary view of two adjacent brick panels in side-by-side relationship after installation but before application of mortar.

As evident from FIG. 1, alternating rows or courses of brick project beyond the edges of board 12, while the intermediate courses have an unbricked portion 18 adapted to receive the similarly projecting bricks of an adjacent panel. FIG. 2 shows a portion of two adjacent installed panels, the panels abutting along a joint line 20. The brick panels 10 are initially applied to a supporting structure such as wood studs 22 by hand driven or power driven nails through the open spaces between bricks 14 as shown in FIG. 2. Mortar 24 is then applied to the spaces between adjacent bricks 14 to complete the installation and to render the finished wall indistinguishable from a conventionally bricked wall.

Figure 4:
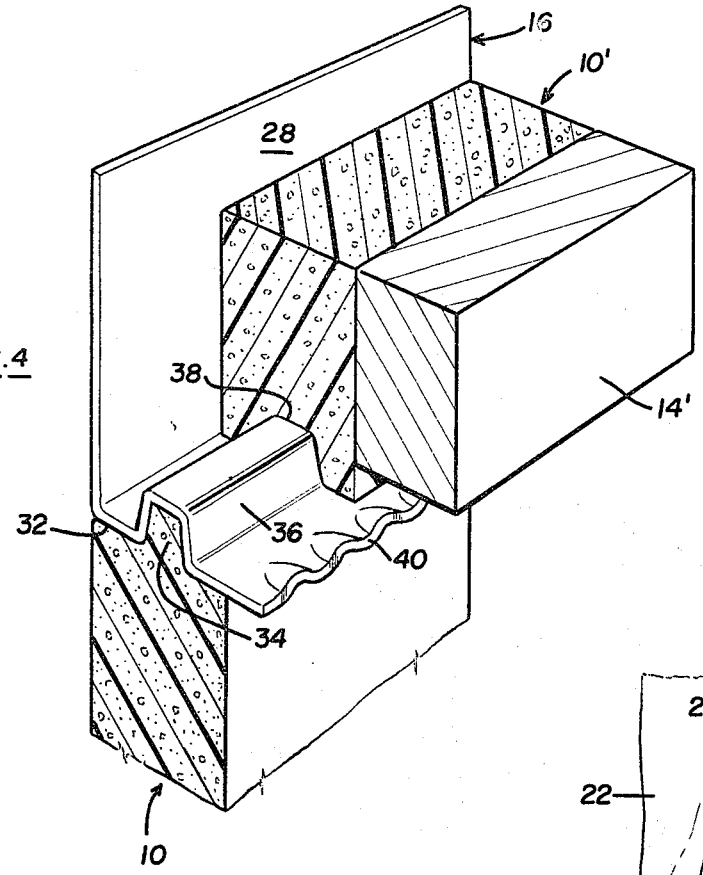
FIG. 4 is a fragmentary perspective view of a load bearing clip sandwiched between two adjacent plastic foam backing boards before the application of mortar.
Figure 5:
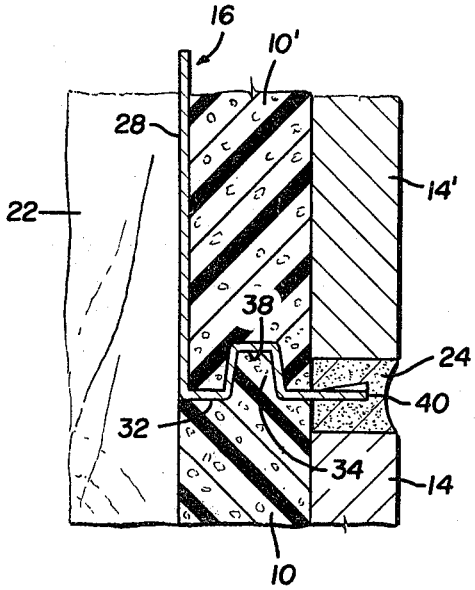
FIG. 5 is a fragmentary side elevational view illustrating the load bearing clip member and two adjacent brick panels after mortar has been applied.
Figure 3:
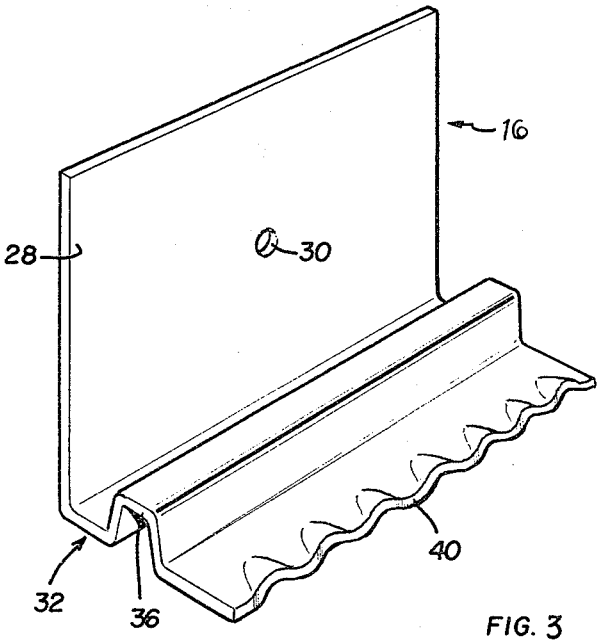
FIG. 3 is a perspective view of a preferred embodiment of the load bearing clip of the present invention.

An important feature of the present invention resides in the individual load-bearing clip members 16, illustrated in FIGS. 3–5. Each clip member 16 includes a vertical leg 28 which is attached to a wall stud 22 by nailing through opening 30 in leg 28. Clip member 16 further includes an outwardly projecting leg 32 that extends into the joint area between the bricks 14′ and 14 of adjacent upper and lower panels 10′ and 10.

In attaching the brick panels to an existing supporting structure such as the stud wall illustrated, the lowermost panels 10 are attached to the wall studs 22 with their tongues 34 exposed and aligned. Prior to installing the lowermost panels on the wall studs 22, a full length base channel (not shown), ten to twelve feet long, is attached to the studs for sealing the bottom of the wall against rodents and the like. A plurality of load bearing clip members 16 are then secured to the wall studs 22 along panels 10 (FIG. 1) with the complimentary tongue and groove surfaces 36 of members 16 (FIG. 3) fitted over the panel tongues 34. The grooved edges 38 of upper panels 10′ are then pressed into position such that the load bearing clip members 16 are sandwiched within the tongue and groove joint between upper and lower panels 10′ and 10.

Load bearing member 16 includes a protruding terminal lip 40 on its outwardly projecting leg 32 that extends into the joint area between the upper and lower bricks 14′, 14 of adjacent panels as illustrated in FIGS. 4 and 5. When mortar 24 is packed or tuck pointed into the joint area to cover the protruding lip 40, member 16 becomes the support for the bricks 14 that are secured to the backing boards 12. For testing purposes, the backing boards 12 have been stripped away and the brick wall has remained intact being supported solely by load bearing members 16. Thus, the present invention provides an insulating and moisture resistant plastic foam backing board 12, and a direct mechanical connection of bricks 14 to wall supporting structure 22 through members 16, such that the support for the bricks is not dependent upon the relatively non-structural backing boards 12.

As illustrated in FIG. 3, the outer terminal end 40 of member 16 is sinusoidally configured along its longitudinal extent. This has proved to enhance the structural integrity of the mortared joints between the bricks 14′ and 14 of upper and lower panels 10′ and 10 and prevent deterioration of that critical joint area. Further, terminal end 40 provides lateral support to the wall against lateral stresses resulting from wind loads and the like.

It will be apparent to those skilled in the art that the foregoing disclosure is exemplary in nature rather than limiting, the invention being limited only by the appended claims.

I claim:

1. A brick panel wall construction including a plurality of brick panels, said brick panels being secured to supporting structure, each brick panel including an insulating plastic foam backing board having a plurality of bricks secured thereto in a pattern, said brick panels including tongue and groove joints in their longitudinal edges such that a tongue at one edge of a first brick panel being accommodated in a groove in the adjacent edge of a second panel;

at least one load bearing member being sandwiched between the tongue and groove joint between adjacent brick panels and means for attaching said member to said supporting structure, said member including a protruding lip extending into a joint area between the bricks on the adjacent panels; and mortar applied to the spaces between the bricks on said backing boards and to the joint area between bricks of adjacent panels to cover the protruding lip of said load bearing member wherein said member providing the load bearing support for the bricks that are secured to said backing boards.

2. The brick panel wall construction as defined in claim 2 wherein said protruding lip being sinusoidally configured along its longitudinal extent to resist lateral loads on said panels.

* * * * *

UNITED STATES PATENT AND TRADEMARK OFFICE

CERTIFICATE OF CORRECTION

PATENT NO. : 4,407,104

DATED : October 4, 1983

INVENTOR(S) : Gerald T. Francis

It is certified that error appears in the above-identified patent and that said Letters Patent is hereby corrected as shown below:

In column 4, cancel lines 36-60 and insert the following claims:

1. A brick panel wall construction including a plurality of brick panels, said brick panels being secured to supporting structure, each brick panel including an insulating plastic foam backing board having an outer face and a plurality of bricks secured thereto in a pattern, said brick panels including tongue and groove joints in their longitudinal edges such that a tongue at one edge of a first brick panel being accommodated in a groove in the adjacent edge of a second panel;

at least one generally L-shaped load bearing member for securing said brick panels to said supporting structure, said load bearing member having a first generally rectangular and planar leg and a second leg wherein said second leg being connected to said first leg along one edge thereof and said second leg being disposed generally perpendicular to said first leg, means for attaching said first leg to said supporting structure, said second leg extending into a joint area between the bricks of adjacent panels, said second leg including a portion that is shaped to match the tongue and groove joint between adjacent panels, said second leg portion being sandwiched within said tongue and groove joint, and said second leg including an outer terminal protruding lip portion which extends beyond the outer faces of said backing boards and into the joint area between the bricks of adjacent panels; and mortar applied to the spaces between the bricks on said backing boards and to the joint area between bricks of adjacent panels to cover the protruding lip portion of said load bearing member wherein said generally L-shaped load bearing member providing a direct mechanical

UNITED STATES PATENT AND TRADEMARK OFFICE

CERTIFICATE OF CORRECTION

PATENT NO. : 4,407,104

DATED : October 4, 1983

INVENTOR(S) : Gerald T. Francis

It is certified that error appears in the above-identified patent and that said Letters Patent is hereby corrected as shown below:

connection between said bricks and said supporting structure whereby the load bearing support for the bricks is not dependent upon the relatively non-structural backing boards.

2. The brick panel wall construction as defined in claim 1 wherein said protruding lip portion being sinusoidally configured along its longitudinal extent to resist lateral loads on said panels.

Signed and Sealed this

Twenty-fourth Day of February, 1987

*Attest:*

DONALD J. QUIGG

*Attesting Officer* *Commissioner of Patents and Trademarks*